US005474055A

United States Patent [19]

Kang

[11] Patent Number: 5,474,055

[45] Date of Patent: Dec. 12, 1995

[54] DEVICE FOR INHIBITING INCREASE IN TEMPERATURE IN GAS COOKER

[75] Inventor: Chang-Su Kang, Suwon, Rep. of Korea

[73] Assignee: Tong Yang Magic Corp., Seoul, Rep. of Korea

[21] Appl. No.: 331,470

[22] Filed: Oct. 31, 1994

[30] Foreign Application Priority Data

Sep. 8, 1994 [KR] Rep. of Korea ..... 1994-22624

[51] Int. Cl.[6] ..... F24C 3/00

[52] U.S. Cl. ..... 126/39 R; 99/337; 99/447; 126/39 A; 126/39 C; 126/42; 126/273 R

[58] Field of Search ..... 99/337, 400, 401, 99/444–446, 447; 126/39 R, 39 A, 39 C, 41 R, 42, 39 D, 39 J, 273 R, 273 A, 273.5, 116 R, 116 B

[56] References Cited

U.S. PATENT DOCUMENTS

| | | | |
|---|---|---|---|
| 3,698,378 | 10/1972 | Rosenberg et al. | 126/39 R |
| 4,527,539 | 7/1985 | Kay | 126/39 R |
| 4,705,020 | 11/1987 | Hahn | 126/41 R |
| 4,788,529 | 11/1988 | Lin | 126/39 R |
| 4,817,582 | 4/1989 | Oslin et al. | 99/474 |
| 4,886,043 | 12/1989 | Homer | 126/39 R |
| 5,031,602 | 7/1991 | Vick | 99/339 |
| 5,101,805 | 4/1992 | Noh | 126/273 R |
| 5,295,476 | 3/1994 | Herbert | 126/39 J |
| 5,317,992 | 6/1994 | Joyce | 126/389 |
| 5,368,012 | 11/1994 | Chamberlain | 126/110 R |
| 5,375,996 | 12/1994 | Nakamura et al. | 126/39 J |

*Primary Examiner*—Timothy F. Simone
*Attorney, Agent, or Firm*—Lowe, Price, LeBlanc & Becker

[57] ABSTRACT

A device for inhibiting an increase in temperature in a gas cooker including a cooker body, a combustion chamber defined in the cooker body and provided with an upper burner and a lower burner both constituting a grille, a manipulation unit disposed at a front portion of the cooker body, and a flue communicated with the combustion chamber, the device comprising a plurality of air intake ports provided between the grille and the manipulation unit, an air passage communicated at one end thereof with the air intake ports and at the other end thereof with the duct, the air passage being disposed above the combustion chamber, an insulating member disposed between the air passage and the combustion chamber, and an exhaust port communicated with an outlet of the combustion chamber and the duct, whereby a natural convection type cooling construction utilizing a heat generated by a combustion carried out in the combustion chamber is obtained. By this construction, it is possible to eliminate problems of an increase in manufacture cost and a generation of noise encountered in a forced exhaust system. It is also possible to achieve a convenient and safe use of the gas cooker because the gas cooker is maintained at its cooled state.

10 Claims, 3 Drawing Sheets

DEVICE FOR INHIBITING INCREASE IN TEMPERATURE IN GAS COOKER

BACKGROUND OF THE INVENTION

1. Field of the Invention

The present invention relates to inhibition of an increase in temperature occurring in a gas cooker such as a gas oven range or a gas range, and more particularly to a device for inhibiting an increase in temperature occurring at parts of the gas oven range such as a manipulation panel, a cock assembly and a knob, capable of achieving a safe use of the gas oven range and lengthening the use life of gas oven range.

2. Description of the Prior Art

Generally, gas cookers mainly used in home, namely, gas oven ranges and gas ranges utilize fume generated from gas being injected by a burner to cook a food. However, a manipulation panel, a cock assembly and a knob constituting a part of the gas cooker may be heated when they are exposed to the generated fume for long time because the fume is at a very high temperature. As a result, a user may get burnt in the hand upon touching the heated elements. Moreover, the heated elements may be deteriorated, so that their life may be shortened.

A hot exhaust gas generated when the burner installed in a combustion chamber of the gas cooker performs a combustion of fuel gas heats parts of the gas cooker disposed around the combustion chamber. The heat is transferred to a gas device equipped in the gas cooker, thereby causing the gas device to be deteriorated. Moreover, the user may get burnt in the hand upon touching the heated gas device.

For solving such a problem, there has been proposed a device for inhibiting an increase in temperature occurring in the gas cooker by a forced exhaust using a fan. However, this device has a noise problems caused by noise generated upon driving the fan and noise generated when air strikes blades of the fan. Since the device utilizes the forced exhaust system, the provision of the fan adapted to only decrease the temperature of particular parts of the gas cooker such as the cock assembly and the knob is essentially required. Due to such a requirement, the manufacture cost of the gas cooker is increased. Consequently, there has been a demand of an inexpensive temperature increase inhibiting device for gas cooker.

SUMMARY OF THE INVENTION

Therefore, an object of the invention is to solve the above-mentioned problems encountered in the prior art, namely, the problem caused by the increase in temperature of gas cooker and the noise problem caused by the forced exhaust and, thus, to provide a device for inhibiting an increase in temperature in a gas cooker, having a simple construction capable of introducing an external air in a natural convection manner and circulating the introduced air to inhibit an increase in temperature of gas cooker without generation of noise.

In accordance with the present invention, this object can be accomplished by providing a device for inhibiting an increase in temperature in a gas cooker including a cooker body, a combustion chamber defined in the cooker body and provided with an upper burner and a lower burner both constituting a grille, a manipulation unit disposed at a front portion of the cooker body, and a flue communicated with the combustion chamber, the device comprising: at least one air intake port provided between the grille and the manipulation unit; an air passage communicated at one end thereof with the air intake port and at the other end thereof with the duct, the air passage being disposed above the combustion chamber; an insulating member disposed between the air passage and the combustion chamber; and an exhaust port communicated with an outlet of the combustion chamber and the duct.

BRIEF DESCRIPTION OF THE DRAWINGS

Other objects and aspects of the invention will become apparent from the following description of embodiments with reference to the accompanying drawings in which.

DETAILED DESCRIPTION OF THE PREFERRED EMBODIMENTS

Figure 1:
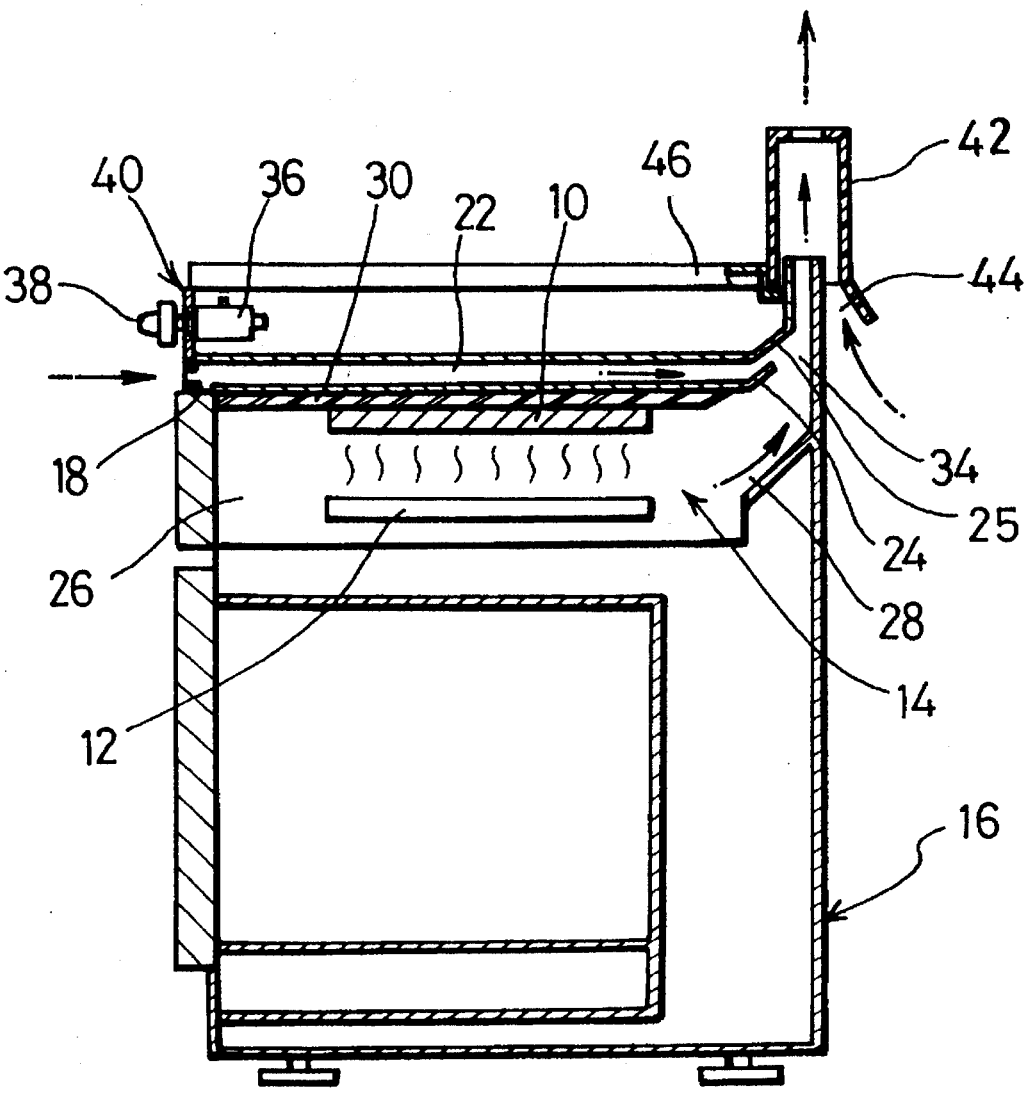
FIG. 1 is a sectional view of a gas oven range equipped with a device for inhibiting an increase in temperature in the gas oven range in accordance with the present invention.
Figure 2:
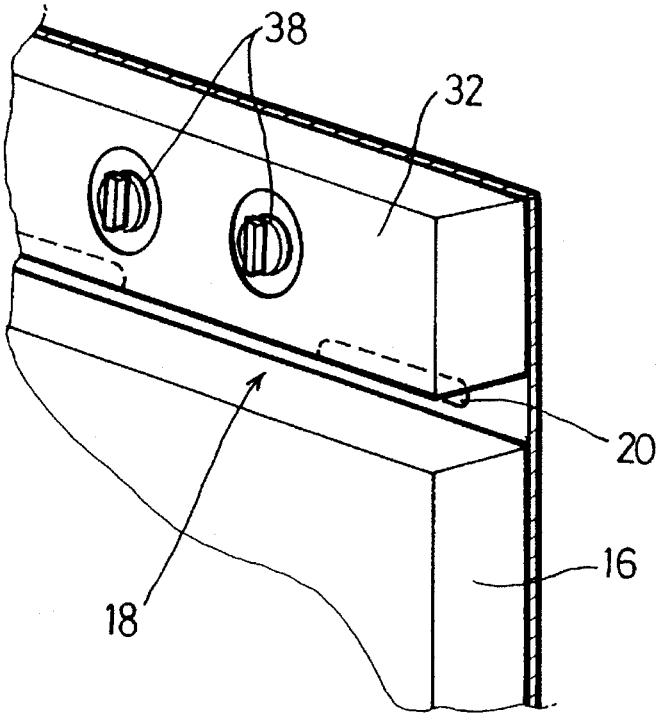
FIG. 2 is a perspective view of a part of the gas oven range, illustrating an air introduction groove of the temperature increase inhibiting device in accordance with the present invention.
Figure 3:
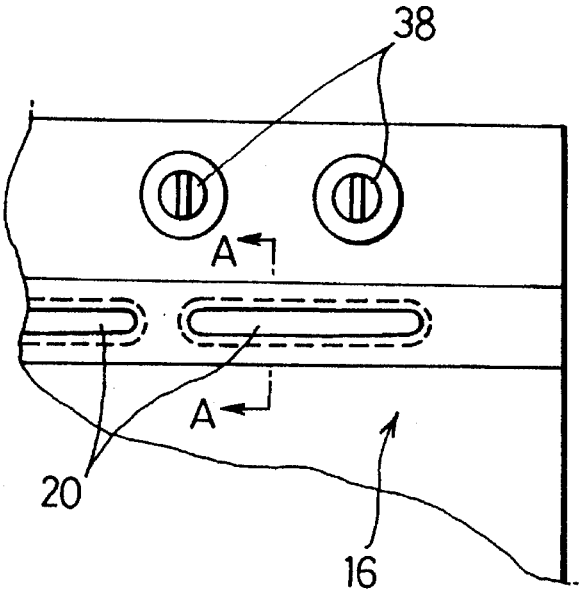
FIG. 3 is a front view corresponding to FIG. 2.
Figure 4:
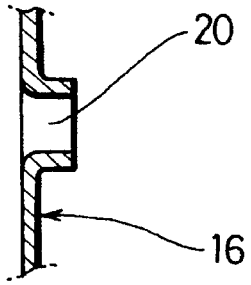
FIG. 4 is a cross-sectional view taken along the line A—A of FIG. 3.
Figure 5:
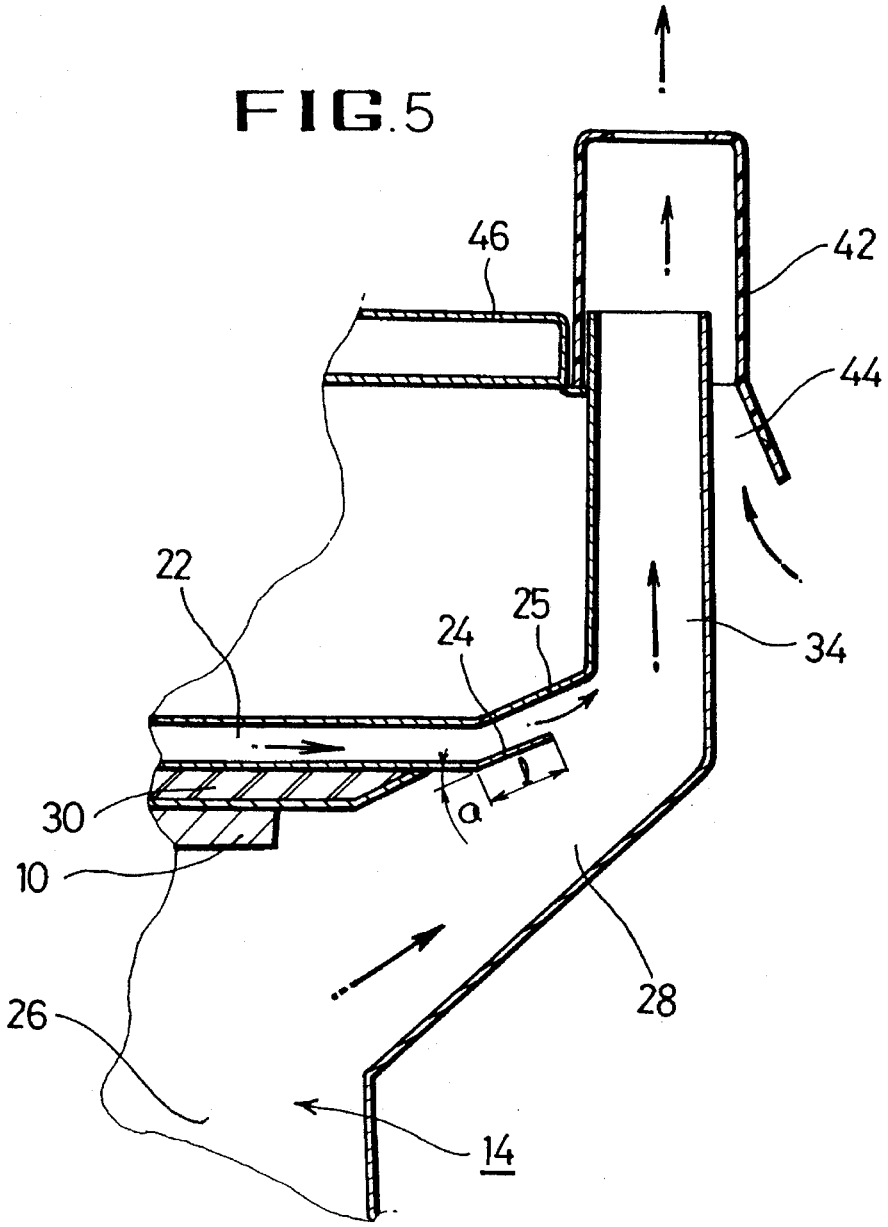
FIG. 5 is a sectional view of a part of the gas oven range, illustrating an air passage of the temperature increase inhibiting device in accordance with the present invention.

Referring to FIGS. 1 to 5, there is illustrated a gas cooker equipped with a device for inhibiting an increase in temperature in the gas cooker in accordance with the present invention.

As shown in FIGS. 1 to 5, the gas cooker includes an upper burner 10 and a lower burner 12 both constituting a grille 14. The reference numeral 16 denotes a cooker body of the gas cooker provided at the front portion thereof with a manipulation unit 40. At the front portion of the body 16, a laterally extending air guide groove 18 is provided between the grille 14 and the manipulation unit 40. The air guide groove 18 is provided with a plurality of uniformly spaced air intake ports 20 communicated with an air passage 22. A vertically extending flue 34 is communicated with the air passage 22.

An introduction guide member 24 is disposed at the rear end of air passage 22 rearwardly extending from the air guide groove 18. At the rear end of air passage 22, a double-bent slant member 25 is also disposed above the introduction guide member 24. The slant member 25 extends upwards to define the flue 34.

At the upper end of flue 34, a vertically extending back guard 42 is disposed such that it surrounds a predetermined length, for example, 12 mm of the upper portion of flue 34 at its lower end. Between the overlapping portions of the flue 34 and back guard 42, an external air inlet 44 is defined. The back guard 42 has an extension extending from one side of the lower end of back guard 42. The extension is Outwardly bent through an angle of 20°.

A combustion chamber 26 is defined at the upper portion of grille 14. The combustion chamber 26 is provided at its rear end with an inclined exhaust port 28. The exhaust port 28 has a cross-sectional area approximately corresponding to four times that of the flue 34. An insulating member 30 is provided at the upper portion of combustion chamber 26.

The rear end of insulating member 30 is inclined such that it guide rapidly the waste gas to the flue 34.

On the other hand, the air guide member 24 is inclined upwards through an angle of 18° to 24° . The length of inclined air guide member 24 measured from the rear end of air passage 22, namely, the point of inflexion. Preferably, the angle and length of the air guide member 24 are 20° and 42 mm, respectively.

The air intake ports 20 provided at the air guide groove 18 have a shape protruded inwards from the cooker body 16.

In the drawings, the reference numeral 32 denotes a manipulation panel, 36 a cock assembly, 38 knobs, and 46 a top plate.

As an ignition is carried out by rotating a selected one of the knobs 38 installed on the manipulation panel 32, the upper and lower burners 10 and 12 operate to carry out a combustion in the combustion chamber 26. As the combustion is carried out, the combustion chamber 26 is heated. At this time, a heat source generated during the combustion may serve to increase the temperature of the cock assembly 36 and knobs 38 disposed above the combustion chamber 26.

However, the insulating member 30 disposed at the upper portion of combustion chamber 26 serves to shield conduction and convection heat generated in the combustion chamber 26. As a result, a high temperature difference of several tens degrees centigrade may be maintained between the air intake ports 20 positioned in the front of the cooker body 16 and the exhaust port 28 adapted to exhaust waste gas and waste heat generated in the combustion chamber 26.

Since the rear end of insulating member 30 is inclined, the waste gas can be rapidly guided to the flue 34.

Also, since the exhaust port 28 has a cross-sectional area corresponding to four times that of the flue 34, the waste gas and waste heat exhausted through the exhaust port 28 and the flue 34 can be rapidly discharged out of the combustion chamber 26.

In particular, such an exhaust of the waste gas and waste heat is accelerated by a natural convection of air introduced in the air passage 22 provided above the insulating member 30 and the upwardly inclined construction of the air guide member 24 provided at the rear end of air passage 22, and the construction of the double-bent slant member 25 extending in parallel to the air guide member 24 above the air guide member 24.

The waste gas and waste heat generated in the combustion chamber 26 are mixed with the air introduced in the air passage 22 while passing through the exhaust port 28. As a result, the waste gas and waste heat are exhausted through the flue 34 at a flow rate resulted from the natural convention.

Since the upwardly bent air guide member 24 provided at the rear end of air passage 22 has the length of 38 to 45 mm, preferably 42 mm, measured from the point of inflexion and the angle of 18 to 24° , preferably 20° , the air is ideally discharged into the flue 34 out of the air passage 22, thereby enabling the waste gas and waste heat exhausted from the combustion chamber 26 to be discharged along the flue 34 in a natural convection manner.

The interior of the air passage 22 is maintained under a vacuum condition because the rear end of air passage 22 is opened to the flue 34 in which the waste gas and waste heat flow. By this vacuum condition, external air is naturally introduced in the air passage 22 through the air intake ports 20 and guided to the flue 34 along the air passage 22. That is, the air flows smoothly along the air passage 22 in a natural convection manner without generating any noise. This air flow serves to shield the heat source generated in the combustion chamber 26, thereby preventing the cock assembly 36 and knob 38 installed on the manipulation panel 32 from increasing in temperature In particular, the air flow shields conduction heat. As a result, it is always ensured to use the gas cooker safely.

Since the back guard 42 is separably mounted on the flue 34, it can not only promote the combustion, but also allow an easy cleaning of the flue 34. As mentioned above, the external air inlet 44 is provided at the lower end of back guard 42 surrounding the upper end of flue 34. By the external air inlet 44, external air is introduced in the flue 34 during the exhaust gas is exhausted through the flue 34, thereby enabling the exhaust gas to be easily exhausted. In particular, since the upper end of flue 34 is inserted in the lower end of back guard 42 by 12 mm, the mounted condition of the back guard 42 is safe. Also, the back guard 42 has the extension outwardly bent from the one side of the lower end of back guard 42, thereby enabling the external air to be smoothly guided to the interior of flue 34. As a result, a natural convection of air is obtained. By virtue of such a natural convection or,air, the exhaust rate of the exhaust gas is enhanced. As apparent from the above description, the present invention provides a cooling construction for a gas cooker constructed to be of the natural convection system utilizing a heat generated by a combustion carried out in a combustion chamber. By such a construction, it is possible to eliminate problems of an increase in manufacture cost and a generation of noise encountered in the forced exhaust system. Furthermore, it is possible to achieve a convenient and safe use of the gas cooker because the gas cooker is maintained at its cooled state.

Although the preferred embodiments of the invention have been disclosed for illustrative purposes, those skilled in the art will appreciate that various modifications, additions and substitutions are possible, without departing from the scope and spirit of the invention as disclosed in the accompanying claims.

What is claimed is:

1. A device for inhibiting an increase in temperature in a gas cooker including a cooker body, a combustion chamber defined in the cooker body and provided with an upper burner and a lower burner both constituting a grille, a manipulation unit disposed at a front portion of the cooker body, and a flue communicated with the combustion chamber, the device comprising:

at least one air intake port provided between the grille and the manipulation unit;

an air passage communicated at one end thereof with the air intake port and at the other end thereof with the duct, the air passage being disposed above the combustion chamber;

an insulating member disposed between the air passage and the combustion chamber; and an exhaust port communicated with an outlet of the combustion chamber and the duct.

2. A device in accordance with claim 1, further comprising an air guide member provided at a lower portion of the other end of the air passage.

3. A device in accordance with claim 2, wherein the air guide member is bent upwards through a predetermined angle.

4. A device in accordance with claim 3, wherein the air guide member has a predetermined length measured from a point of inflexion of the air guide member.

5. A device in accordance with claim 1, wherein the exhaust port has a cross-sectional area corresponding to four times that of the duct.

6. A device in accordance with claim 1, further comprising a double-bent slant member provided at an upper portion of the other end of the air passage.

7. A device in accordance with claim 1, wherein the air intake port provided between the grille and the manipulation unit is protruded into an interior of the cooker body.

8. A device in accordance with claim 1, further comprising a back guard partially fitted around the flue and provided with an external air inlet defined between the flue and the back guard.

9. A device in accordance with claim 1, further comprising a back guard fitted at a lower end thereof around an upper end of the duct.

10. A device in accordance with claim 8, wherein the back guard has an extension extending one side of a lower end of the back guard such that it is bent through a predetermined angle.

* * * * *